US007527040B2

(12) United States Patent
Couch

(10) Patent No.: US 7,527,040 B2
(45) Date of Patent: May 5, 2009

(54) FUEL INJECTION PERFORMANCE ENHANCING CONTROLLER

(75) Inventor: David K. Couch, Idaho Falls, ID (US)

(73) Assignee: Boondocker LLC, Idaho Falls, ID (US)

( * ) Notice: Subject to any disclaimer, the term of this patent is extended or adjusted under 35 U.S.C. 154(b) by 276 days.

(21) Appl. No.: 11/313,425

(22) Filed: Dec. 21, 2005

(65) Prior Publication Data

US 2007/0137620 A1 Jun. 21, 2007

(51) Int. Cl.
*F02M 51/00* (2006.01)
*H01H 47/00* (2006.01)

(52) U.S. Cl. ..... 123/490; 361/152

(58) Field of Classification Search ..... 123/490; 361/152, 154, 155
See application file for complete search history.

(56) References Cited

U.S. PATENT DOCUMENTS

| | | | | |
|---|---|---|---|---|
| 4,209,829 | A | 6/1980 | Leichle | 364/442 |
| 4,355,619 | A | 10/1982 | Wilkinson | 123/490 |
| 4,499,878 | A | 2/1985 | Igashira et al. | 123/478 |
| 4,649,886 | A | 3/1987 | Igashira et al. | 123/498 |
| 5,515,830 | A | 5/1996 | Arakowa | 123/490 |
| 5,941,216 | A | 8/1999 | Arakawa | 123/490 |
| 5,954,030 | A | 9/1999 | Sturman et al. | 123/446 |
| 6,005,763 | A | 12/1999 | North | 361/154 |
| 6,102,008 | A | 8/2000 | Maeda et al. | 123/490 |
| 6,286,492 | B1 | 9/2001 | Kanno | 123/684 |
| 6,923,163 | B2 | 8/2005 | Yamazaki | 123/490 |
| 7,000,599 | B2 | 2/2006 | Kirkpatrick | 123/490 |
| 7,124,742 | B1 * | 10/2006 | Kirkpatrick | 123/490 |
| 2005/0111160 | A1 * | 5/2005 | Faggioli et al. | 361/154 |

* cited by examiner

*Primary Examiner*—Stephen K Cronin
*Assistant Examiner*—Arnold Castro
(74) *Attorney, Agent, or Firm*—John R. Thompson; Stoel Rives LLP

(57) ABSTRACT

An auxiliary electronic fuel injection control apparatus for enhancing engine performance includes an isolation circuit connectable to a main control switch having an output voltage pulse and a ground. A pass-through switch is in electrical communication with the isolation circuit and is connectable to a fuel injector, the isolation circuit designed to substantially render the pass-through switch transparent to the main control switch. A re-driver switch is in electrical communication with the pass-through switch and is connectable to the fuel injector and the ground. An auxiliary controller is in electrical communication with the isolation circuit, the pass-through switch, the re-driver switch, and to the ground. The output voltage pulse triggers the auxiliary controller to turn the pass-through switch and the re-driver switch on and off to effectively alter a duration of current to the fuel injector.

48 Claims, 11 Drawing Sheets

FUEL INJECTION PERFORMANCE ENHANCING CONTROLLER

TECHNICAL FIELD

The present invention relates to fuel injection control, and more particularly, to auxiliary fuel injection control for performance enhancement.

BRIEF DESCRIPTION OF THE DRAWINGS

Understanding that these drawings depict only typical embodiments of the disclosure and are not therefore to be considered as limitations of its scope, the disclosure will be described and explained with additional specificity and detail through the use of the accompanying drawings in which.

DETAILED DESCRIPTION OF PREFERRED EMBODIMENTS

Figure 1:
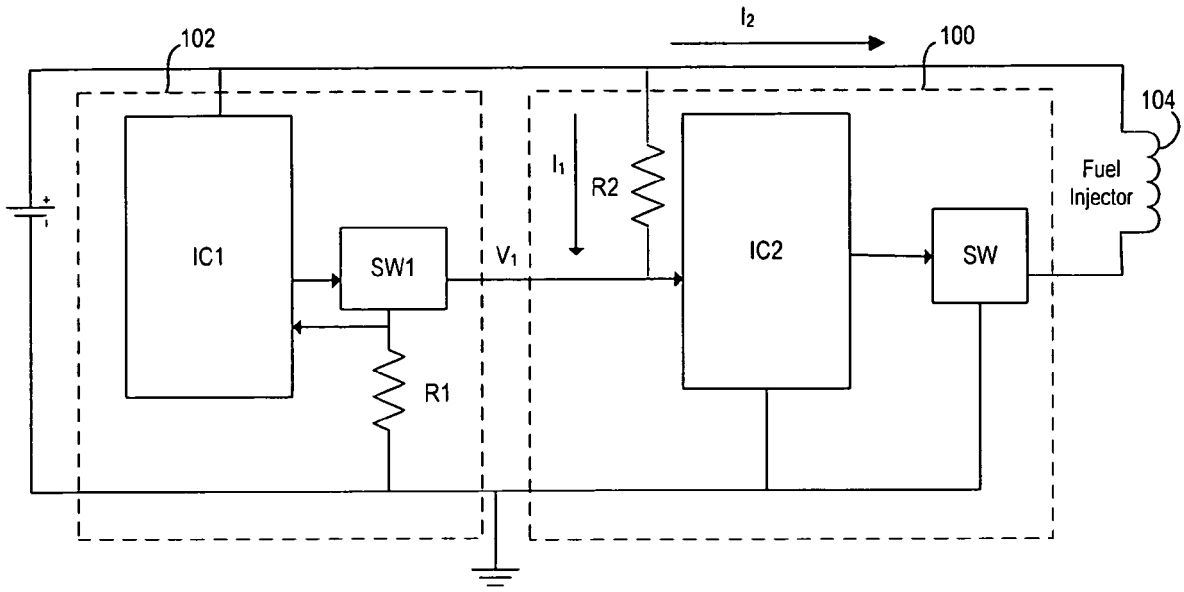
FIG. 1 is a block diagram of a re-drive system for a fuel injector having a main controller.

Reference is now made to the figures in which like reference numerals refer to like elements. For clarity, the first digit or digits of a reference numeral indicates the figure number in which the corresponding element is first used.

Throughout the specification, reference to "one embodiment" or "an embodiment" means that a particular described feature, structure, or characteristic is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. Those skilled in the art will recognize that the invention can be practiced without one or more of the specific details, or with other methods, components, materials, etc. In other instances, well-known structures, materials, or operations are not shown or not described in detail to avoid obscuring aspects of the disclosure.

In addition, those skilled in the art will appreciate that the embodiments of the control systems referenced in FIGS. 1 through 10 may control the current drive of one or more injectors, and may in addition drive a bank of injectors, each bank containing multiple injectors. Thus, reference to "an" or "the" injector should not limit the scope of this disclosure, as claimed.

Also, the term "in electrical communication with," as used herein does not infer that electrical parts need to be coupled to or directly connected. The term "in electrical communication with," implies that two electrical components may communicate or talk to each other through the sending and receiving of electrical signals, whether of high or low voltage and/or high or low current.

FIG. 1 displays one embodiment of an auxiliary fuel injector control apparatus, known as a re-driver 100. The re-driver apparatus 100 connects between the main control system 102, having a main control switch SW1, and at least one injector 104, which acts electrically as an inductor. The re-driver apparatus 100 receives a main control 102 voltage signal, which has a pulse-width. To enhance the performance of an engine using a fuel injector control system 102, the re-driver control system 100 may adjust the pulse-width, providing for a longer or shorter driving period of the injector 104. For instance, a longer pulse will provide more fuel to the engine. In contrast, a shorter pulse will provide less fuel to an engine.

One reason to add fuel is for additional power, such as in drag racing applications. Some of the additional reasons more fuel may need to be added, include, but are not limited to: adapting to engine modifications that increase displacement by using a larger piston and cylinder, intake and exhaust modifications that increase an engine's volumetric efficiency, for adding a nitrous oxide injection system, or for engines that have a supercharger or turbocharger added. Fuel may also need to be added or reduced in order to fine-tune the stock fuel mapping that may be overly lean or rich. Engine sensors can be monitored and fuel can be adjusted accordingly in order to optimize engine performance and also to allow safe engine operation, i.e. to prevent overheating and prevent too lean or too rich conditions.

A high impedance injector is relatively easy to control; the injector need only be connected to a power source, such as a battery, and to the battery's ground. The high electrical impedance limits the electric current passing through the injector to approximately one ampere, small enough to prevent overheating. Thus, the current is allowed to ramp up to its operating level, at which point it enters "saturation." A single switch will generally turn the injector on and off, thus providing for inexpensive control circuitry. Thus, high-impedance controls may be simple, but they also may be more complex in the cases discussed above for modifying the pulse-width and in any injector drive system that monitors the injector current or voltage. There are other high-impedance applications for an auxiliary controller as will be discussed later with reference to FIG. 2.

Low-impedance injectors, in contrast, allow much more current to flow through them, thus allowing them to turn on faster. If a simple switch is thrown, applying a voltage potential across a low-impedance injector, the current in the injector increases rapidly. Without some control over that current surge, the injector would quickly overheat. Typically, low impedance injector controllers allow the current to "peak" to a certain level, and then modulate, or limit, the current in some way, creating a "hold" status where the current is sufficient to keep the injector on without damaging the injector. This hold current level is generally one-quarter the peak current, or approximately one ampere. The typical wait time before switching the control so that the current enters a "hold" status is about one to two milliseconds. One way to limit the current during the "hold" is to use pulse-width modulation (or PWM).

FIG. 1 takes the main control system 102, which could control either a high or low-impedance injector, and augments system 102 by providing for both pulse add (Add) and pulse subtract (Subtract) operations with a re-driver apparatus 100. During pulse Add, controller IC2 observes the main control pulse signal from the main control switch SW1, and re-drives that signal through switch SW. In this way, controller IC2 knows when the pulse transitions between high and low and may alter the pulse-width, re-driving it through re-driver switch SW.

A low-impedance, pull-up resistor R2 may be located between the power source and the main control switch SW1 to provide for a substantial simulation of the current and/or voltage that would normally pass through the injector 104. This frees up the re-drive controller IC2 and the re-drive switch SW to manipulate the signal pulse without significant disruption to the current $I_1$ that may be sensed by the main controller IC1. Current $I_1$ may be sensed, for instance, through use of small resistor R1 (e.g. less than one ohm), and fed back into the main controller IC1.

Main controller IC1 may then decide to alter the voltage pulse-width to adjust the current $I_1$ going through resistor R2 in response to current variations. This may be the case where the fuel injector 104 is low-impedance and controller IC1 is using PWM to control the main control switch SW1. To help controller IC2 determine the original injection pulse-width, controller IC2 may detect the large fly-back pulse that would indicate the injector has been released. Another method may be to detect if a positive pulse is longer than a certain value, which would indicate that the injection pulse is over.

Figures 1A, 1B:
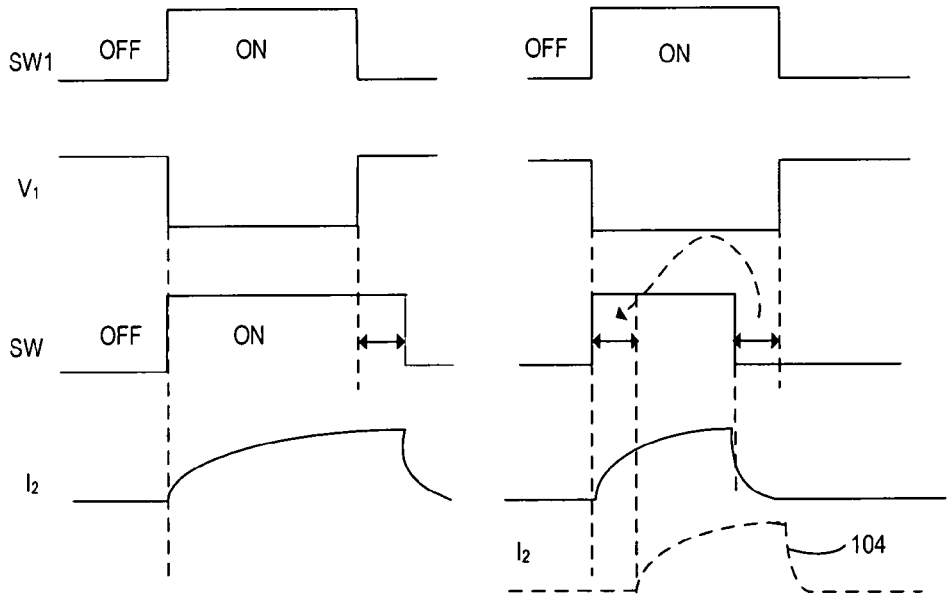
FIG. 1*a* is a set of waveforms showing operation of the system of FIG. 1 during add operation, re-driving high impedance injectors.
FIG. 1*b* is a set of waveforms showing operation of the system of FIG. 1 during subtract operation, re-driving high impedance injectors.

FIG. 1*a* shows the waveforms associated with the Add operation when re-driving high-impedance injectors. When switch SW1 turns on, so does switch SW, but instead of turning off at the same time as switch SW1, switch SW extends the pulse-width of the voltage signal. The result is an extended drive period of injector 104, reflected in the current $I_2$ moving through injector 104. Note that in this application, the voltage at $V_1$ is low when the main control switch SW1 is on, and vice versa.

FIG. 1*b* shows the waveforms associated with the Subtract operation when re-driving high-impedance injectors. Main switch SW1, as before, comes on for a determined pulse period. However, this time re-driver controller IC2 and switch SW turn off for a period at either end of the pulse, effectively shortening the drive period of injector 104, reflected in the current $I_2$ moving through injector 104. The dashed waveform 106 shows how the drive period may start late instead of getting cut off early. The period of extension (Add) or subtraction (Subtract) may be determined through a variety of methods, including as a percentage of the previous pulse-width period, or as a fixed time period. The calculation of Add or Subtract periods will be explained in more detail with reference to FIG. 2 and FIGS. 7-10.

Figure 2:
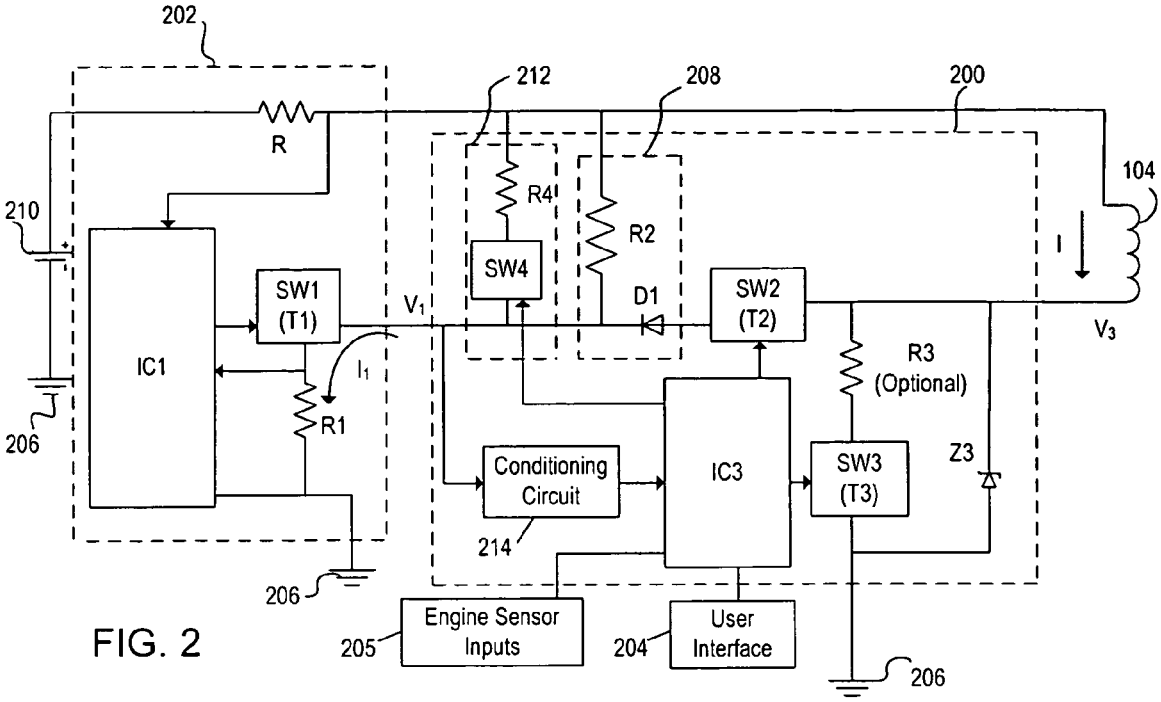
FIG. 2 is a block diagram of an auxiliary fuel injection control apparatus.

FIG. 2 is a block diagram of an auxiliary, fuel injection control apparatus 200 with more sophisticated control circuitry options than the re-driver apparatus 100 of FIG. 1. As with the re-driver system 100, the auxiliary control apparatus 200 may receive a pulsed voltage signal (V1) from the main control system 202, the pulses produced by the main control switch SW1 as reflected in FIGS. 2*a* through 2*c*. Main control system 202 may include an AC-to-DC converter (if required) and may include an additional resistor R, or other current sensing means, which provides current sensing by the main controller IC1 of the source current I. This current sensing may become important in certain applications of the auxiliary control apparatus 200, discussed in detail below.

Central to the auxiliary control apparatus 200 is an auxiliary controller IC3, which may be a microprocessor, or may include other control circuitry. Auxiliary controller IC3 may receive the injector pulsed signal from SW1. The auxiliary controller IC3 may then receive a user input from a user interface 204, from a variety of engine sensor inputs 205, or from a pre-programmed setting. Based on detecting any of these setting, and based on injector signal pulsed transitions between high and low, auxiliary controller IC3 may continuously control other components of the auxiliary control apparatus 200 to Add to or Subtract from the original pulsed signal, or to make no changes at all.

A few of the possible engine sensors 205 that may feed auxiliary controller IC3 include: exhaust temperature sensor, exhaust oxygen sensor, engine coolant temperature sensor, cylinder head temperature sensor, intake manifold pressure sensor, intake airflow sensor, intake air temperature sensor, engine knock sensor, throttle position sensor, barometric pressure sensor, boost pressure sensor, nitrous oxide activation switch, and a nitrous oxide bottle pressure sensor.

The user interface 204 may include a display panel for providing a user output screen to send status signals to a user. User interface 204 may also include one or more buttons to enable a user to input a desired adjustment, such as during various engine revolutions per minute (rpm's) and load conditions. These operational states may then be translated into a level of pulse-width modification, whether to Add or Subtract from the pulse-width.

The display panel could be implemented in a variety of ways, including as a liquid crystal display (character or graphic) or as a plurality of light emitting diodes (LEDs), a 7-segment numeric LED, or a 14-segment alpha-numeric LED, or a vacuum fluorescent display. Another method is to have a separate user interface device, such as a personal display device (PDA), a laptop, or a customer LCD, which communicates via a wired interface, wirelessly, or via infrared. Other devices that may be used in lieu of one or more buttons, such as one or more switches (DIP switches, encoder, etc.), or a potentiometer, or other control means. Furthermore, the user could select whether to optimize fuel economy, emissions, power, or other performance preferences, or to compromise between any combinations of these.

One embodiment of an auxiliary, fuel injection control apparatus 200 may include a pass-through switch SW2. Pass-through switch SW2 may be turned off so that the auxiliary controller apparatus 200 may take over to adjust the pulse-width of the main control signal sent from the main control switch SW1. During Add operation, a re-driver switch SW3 may be electrically connected to the injector 104 and to ground 206, and may be controlled by auxiliary controller IC3 to extend the pulse-width for a calculated period of time. These and other embodiments, including various combinations of the displayed circuitry, will be discussed herein.

A pass-through switch SW2 may be positioned within the electrical connection between the main switch SW1 and the injector 104. When the pass-through switch SW2 is on, switch SW2 may allow substantially the same pulsed signal from SW1 to pass through to control the injector 104 during normal operation. Normal operation, as used herein, refers generally to other-than-Subtract operation. There are a few exceptions where the pass-through switch SW2 will go off during Add operation, which may be the case in the absence of a diode D1 (discussed further with reference to FIGS. 5 and 6). Thus, during Subtract operation, the pass-through switch SW2 may be turned off during a portion of the pulse to allow the auxiliary control apparatus 200 to shorten the pulse-width of the injector signal without disrupting the original injector signal as sensed by the main control system 202.

Use of a pass-through switch SW2 may effect a substantial change from the re-driver apparatus 100 of FIG. 1, in which the re-driver control IC2 was placed between the pulsed signal from switch SW1 and the injector 104, therefore relying on pull-up resistor R2 to provide transparency. This is true if the pull-up resistor R2 is high impedance because current $I_1$ would be too small to mimic the current $I_2$ through injector 104. In this way, the intervening re-driver control IC2 could disturb the original injector signal coming from the main control switch SW1 because the main control circuit IC1 would try to compensate for the smaller current. However, if R2 is low impedance, sized similar to the injector 104, $I_1$ would produce a closer-to-expected value of the injector current as measured by R1, thus providing transparency, but which also causes the drive current to double as both the injector and the simulated load are being driven at the same time. The pass-through switch SW2 in FIG. 2, however, may not entirely resolve the transparency problem either, which will be discussed below with conjunction to the isolation circuit 208.

One embodiment of an auxiliary, fuel injector control apparatus 200 may include an isolation circuit 208 to be added between the pass-through switch SW2 and the main voltage switch SW1. This isolation circuit 208 may include a pull-up resistor R2, which is connected to a DC power source 210, and may help make the auxiliary control system 200 substantially transparent to the main control system 202 where $V_1$ is monitored, as discussed with reference to FIG. 1. Resistor R2 may be larger, about in the range of 1 k to 10 k ohms, to prevent excess current consumption from the power source 210 and to prevent DC supply sense resistor R from detecting excess current usage. That is, if resistor R2 is low impedance, the transparency of the auxiliary controller IC3 may be disturbed: if resistor R is used to sense the source current that goes to the injector and R2, i.e. both $I_1$ and I, R would sense excess current when using a low-impedance R2.

The isolation circuit 208 may optionally contain a diode D1 biased to stop reverse current flow through the pass-through switch SW2. Switch SW2 may be turned off during Subtract operation with diode D1 or may be turned off during both Add and Subtract operations if diode D1 or other isolation is not used. The pass-through switch SW2 may include a metal-oxide semiconductor field-effect transistor (MOSFET), or other appropriate FET designed to handle the voltage and current levels of switching and sustained operation. The diode D1 thus counteracts the effects of the body diode characteristic of MOSFET devices to prevent the pull-down of the pull-up resistor R2 by the re-driver switch SW3. Various embodiments of the isolation circuit 208 and the pass-through switch SW2 will be discussed with reference to FIGS. 5 and 6.

Figure 2A:
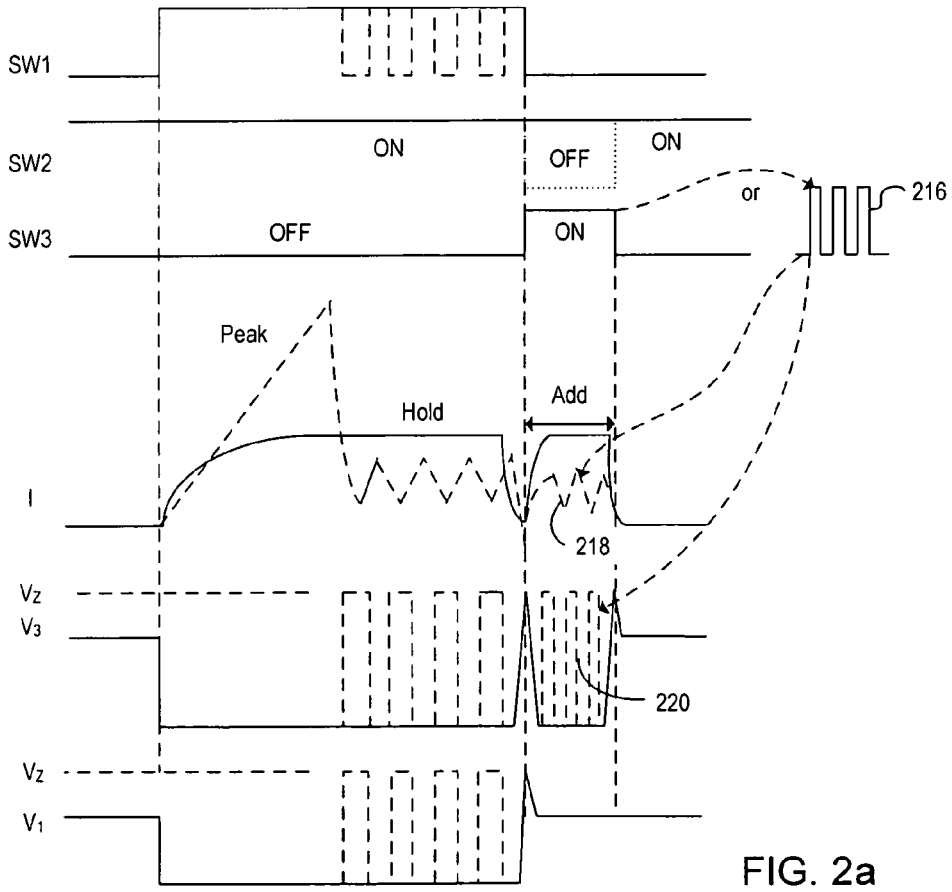
FIG. 2*a* is a set of waveforms showing operation of the apparatus of FIG. 2 during add operation.
Figure 2B:
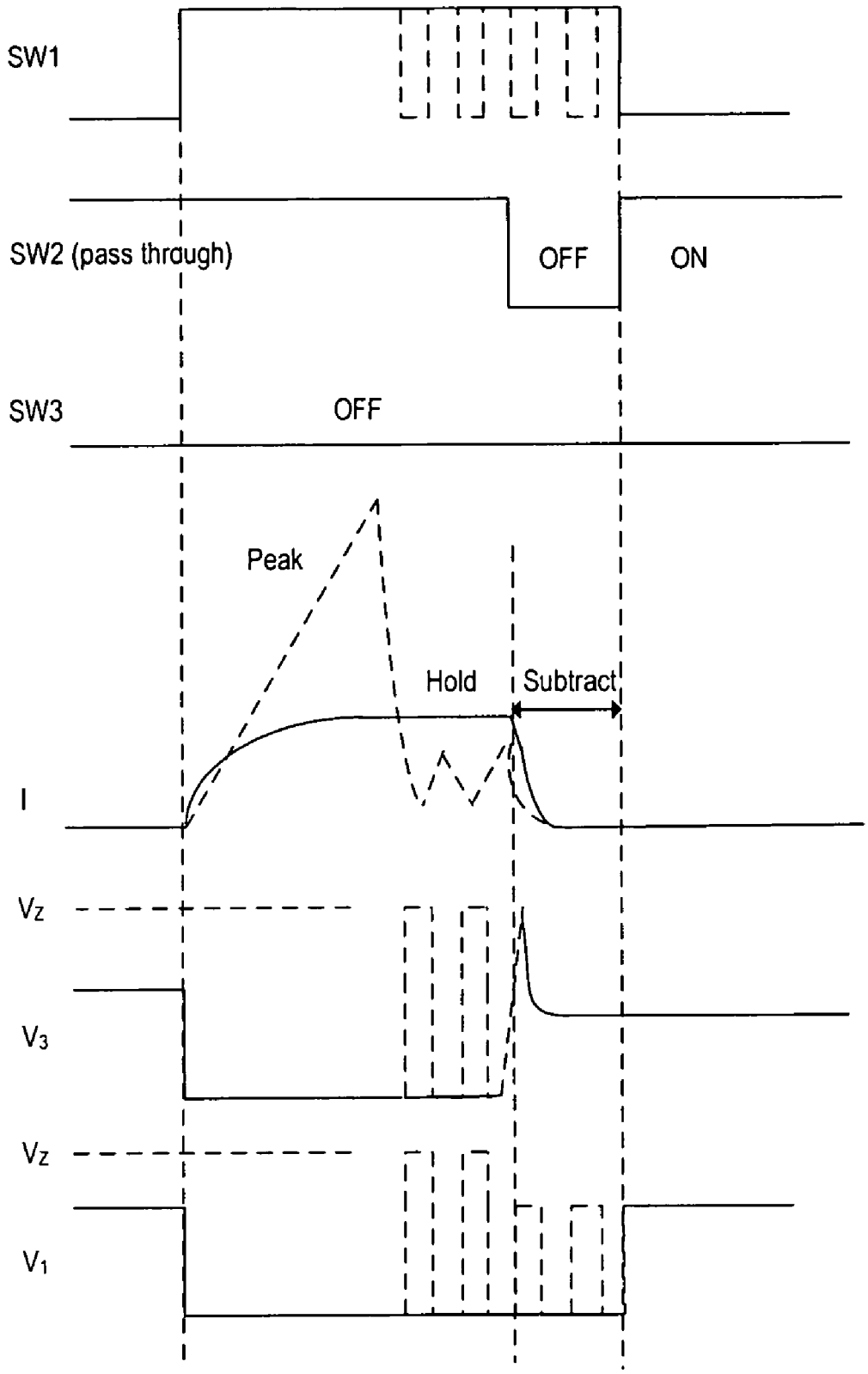
FIG. 2*b* is a set of waveforms showing operation of the apparatus of FIG. 2 during subtract operation.
Figure 2C:
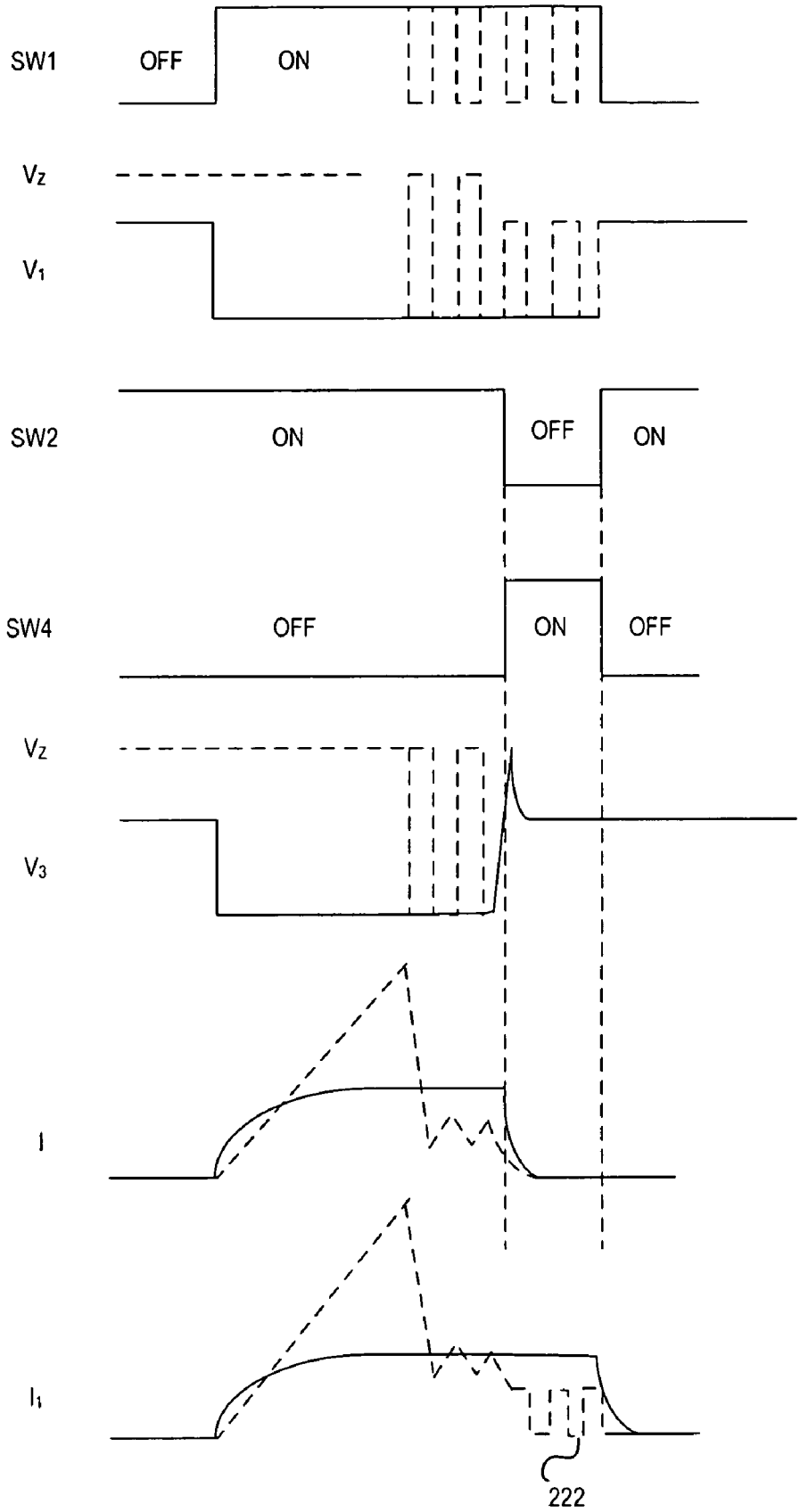
FIG. 2*c* is a set of waveforms showing operation of the apparatus of FIG. 2, including an optional low-impedance load, during subtract operation.

FIG. 2*a* shows the waveforms associated with the Add operation of auxiliary control system 200. As discussed, main control switch SW1 pulses at its normal rate and intensity. The "hold cycle" of the SW1 pulse may provide a lower voltage through use of common means or may be pulse-width modulated so as to provide current limiting during the hold portion of the pulse. The pass-through switch SW2 is always on, except perhaps during the Add period after the end of the pulse (indicated by a dashed line), which case will be discussed further with reference to FIGS. 5 and 6. After the end of the pulse, re-driver switch SW3 turns on and provides the added hold period of the current I sent to the injector 104. The control of the re-driver switch SW3, to limit the current through the injector 104, may include PWM, which option 216 in switch SW3 yields modulated results as displayed in waveforms I (218) and $V_3$ (220), as indicated by the dashed arrows. The dashed waveforms throughout FIGS. 2*a*-2*c* are indicative of driving a low-impedance injector where the main control switch is pulse-width modulated during the hold period to do so. The smooth waveforms are the response to driving a high-impedance injector.

Current waveform I shows the current through the injector 104, which has a normal peak and hold period, but adds on an additional hold period after reacting to re-driver switch SW3 turning on. Voltage $V_3$ at the injector 104 interface shows spikes in voltage before and after the Add period due to the inductive fly-back of the injector during switching at those moments. To protect switches SW2 and SW3 during switching, an overvoltage protection circuit may be employed. Voltage $V_1$ indicates that the voltage between the main control 202 and auxiliary control 200 systems behaves substantially as it would have had the auxiliary control system 200 been absent. The voltage levels of V1 and V3 that extend to $V_Z$ are displayed to indicate that the PWM voltage peaks will fly-back to the overvoltage protection voltage level, i.e., the saturation voltage of a zener diode if that is what is used.

FIG. 2*b*, in contrast, shows the waveforms associated with the Subtract operation. There is no change in the main control signal from switch SW1 nor to the output voltage $V_1$. The pass-through switch SW2 turns off during a calculated time, short of the end of the pulse-width, to bring the hold period to an end sooner. This is reflected in the current waveform I. Waveform $V_3$ also shows large voltage spikes each time SW1 goes off and when the pass-through switch SW2 goes off, which likewise may require addition of an overvoltage protection circuit to protect switches SW2 and SW3. As with the pulse Add operation, voltage peaks of V1 and V3 will fly-back to the overvoltage protection level $V_Z$ during PWM switching.

Referring again to FIG. 2, to further insure transparency during pulse Subtract operation, an optional dummy, low-impedance load 212 may be employed when the main control 202 is monitoring the hold current of $I_1$ closely. Low-impedance load 212 may be positioned between a DC power source 210 and a connection to the main control switch SW1, so that it will draw current as the injector would. The low-impedance load 212 may include a resistor R4 (or an inductor, not shown) and a load switch SW4 in series; the resistor R4 may be positioned between the load switch SW4 and a DC power source 210, or between the load-switch SW4 and the main control switch SW1. In addition, the low-impedance load 212 may be positioned on the pass-through switch SW2 side of diode D1. Furthermore, the resistor R4 (or inductor, not shown) may be removed if the load switch SW4 is biased to supply the correct current or if the load switch SW4 is controlled with PWM to do the same.

Auxiliary controller IC3 may, during pulse Subtract operation, when the pass-through switch SW2 turns off, turn on load switch SW4 so that current $I_1$ will flow making the main controller IC1 see a current hold pattern more akin to responding to a normal-length pulse signal. In addition, if a low-impedance load 212 is used, it may obviate the need for pull-up resistor R2: the pull-up function may variably occur via resistor R4 when load switch SW4 is on, or via the injector 104 when the pass-through switch SW2 is on and the load switch SW4 is off. This is because the low-impedance load 212 may fool main controller IC1 also during an "early Add" operation to think that the current $I_1$ passing through the low-impedance load 212 is coming from the injector 104, despite that additional current I is being pulled through the injector 104 by re-driver switch SW3. The "early Add" case will be discussed in detail with reference to FIG. 7.

FIG. 2*c* displays waveforms indicative of how auxiliary controller apparatus 200 would operate during Subtract operation using a dummy, low-impedance load 212. As discussed, the pass-through switch SW2 goes off while load switch SW4 goes on at a calculated time before the end of the pulse-width. This will limit the pulse-width period, and thus the current I flowing through the injector 104.

In this embodiment, however, with the load switch SW4 on, the current $I_1$ flowing into the main control switch SW1 continues appropriately through the Subtract period, producing a current $I_1$ hold that may be monitored at an expected level by main controller IC1. Because of this additional holding current, as seen by the main control system 202, a current-sensing main controller IC1 will not react to the Subtract operation of the auxiliary control system 200, i.e. through detecting a fault condition. The dashed pulses 222 in waveform $I_1$ shows what the main control current $I_1$ will look like due to the dummy load's operation.

Figure 3:
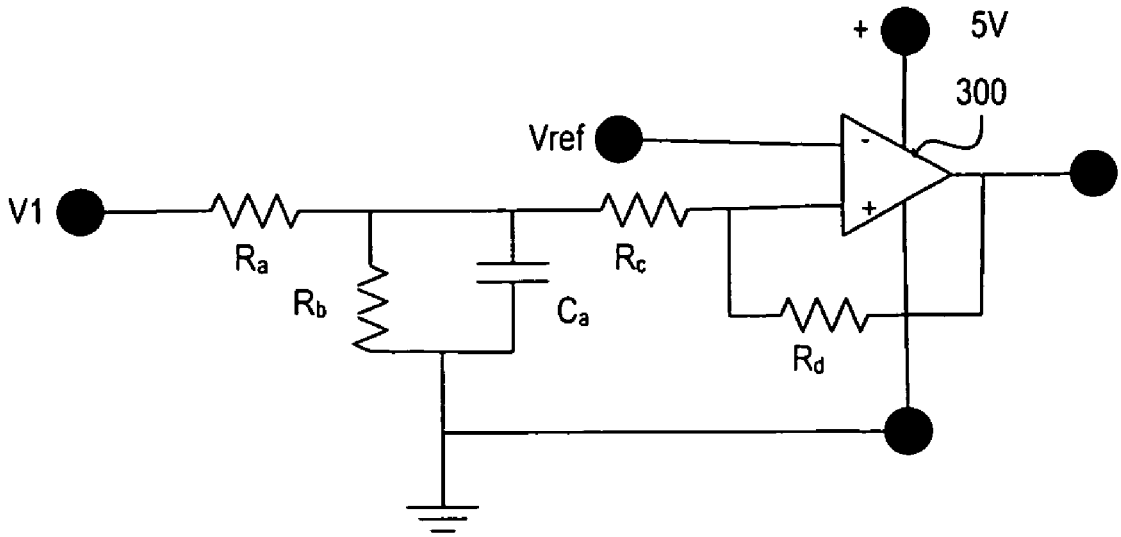
FIG. 3 is a circuit diagram of one implementation of the conditioning circuit of FIG. 2.
Figure 4:
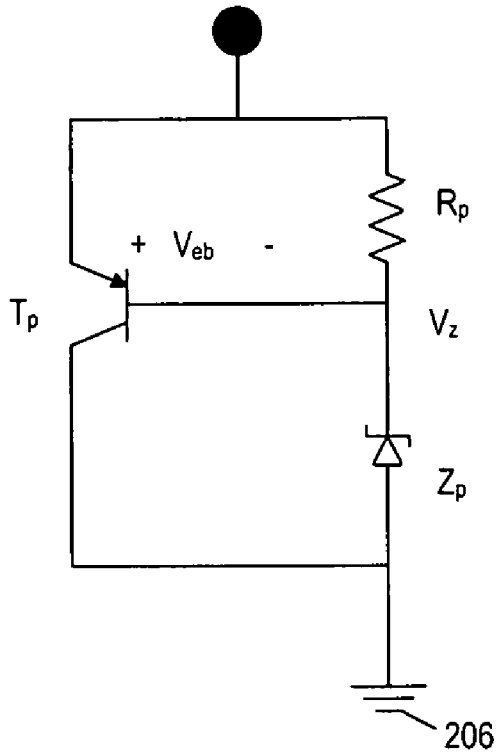
FIG. 4 is a circuit diagram of an alternative implementation to the breakdown diode (Z3) of FIG. 2.

Referring again to FIG. 2, one embodiment may include a signal conditioning circuit 214 placed between the main control switch SW1 output and the auxiliary controller IC3. Any implementation may be used to ensure that the voltage pulse from the main control switch SW1 is stepped down and is sufficiently clean so that auxiliary controller IC3 receives the pulse as a logic signal of between zero and five volts, or a logic signal in a voltage range appropriate for IC3. One embodiment is shown in FIG. 3, which includes a voltage divider ($R_a$ and $R_b$) to divide the voltage down from approximately 12 volts, a low-pass filter ($C_a$ and $R_b$ and $R_a$) to filter out any harmful noise, and a comparator 300 having a hysteresis. The comparator 300 detects the signal and sends an appropriate voltage signal to auxiliary controller IC3.

In one embodiment, upon starting up a battery-less engine with a pull rope, voltage is supplied by the stator to drive the injector 104 and other circuitry. This rising supply voltage 210 may not be strong enough to immediately send a pulsed injector signal that the conditioning circuit 214 may detect. In this case, it is the use of a pass-through switch SW2 of an auxiliary control apparatus 200 that allows the engine to get running. By passing the pulsed injector signal through switch SW2 straight to the injector 104, the supply voltage 210 may stabilize while the conditioning circuit is ignored and pulse-width alteration waits. Once stabilized, the pulsed injector signal is strong enough to be detected by the conditioning circuit 214, and the processor of the auxiliary controller IC3 is initialized and ready to begin.

It is this aspect that makes an auxiliary control apparatus 200, which uses a pass-through switch SW2, also a good option for adjusting the pulse-width of control signals sent to high-impedance injectors in an existing control system that does not monitor currents. Another possible implementation is when an auxiliary controller IC3 requires a large delay (such as due to steady supply voltage requirements, startup house keeping tasks, etc.) before it can start to operate properly or when large processing tasks need to be performed while the engine is operating. The pass-through switch SW2 may be used to allow the engine to start up and the auxiliary controller IC3 could take over after it is properly operating or SW2 may be used to allow IC3 to perform other control tasks and not be required to re-drive the injector.

Pass-through switch SW2 may be a power MOSFET, such as an IRFR120, or any type of common transistor capable of providing the required current and being able to withstand the necessary voltage, including peak flyback voltage, and that can provide as small a voltage drop as possible so as not to reduce or disturb the original current. The ability to withstand necessary voltage may depend on what kind of overvoltage protection is provided, which is discussed below. The ability to not reduce the original current is important because the controller IC1 will sense the current I via resistor R1. A sufficient decrease in current I caused by the pass-through switch SW2 may cause the main controller IC1 to detect a fault condition.

There are a number of embodiments that provide current limiting for the Add operation. One embodiment is to add a resistor R3 in series with a re-driver switch SW3 as shown in FIG. 2. Any configuration that limits the current to about one-fourth the peak current, or from approximately 0.75-1.0 amperes, may be employed. Re-driver switch SW3 may also be a power MOSFET, such as an IRFR120, or any type of common transistor capable of providing the required current and being able to withstand the necessary voltage, including peak flyback voltage.

Another method for limiting the current, mentioned above, may be by eliminating resistor R3 and implementing pulse switching with PWM where the duty cycle provides the necessary hold current.

Yet another method is to place a current sensing resistor between the re-driver switch SW3 and ground 206, and to feed the current value into the auxiliary controller IC3, which could then control the re-driver switch SW3 to provide the desired hold current. Such a current sense resistor may be small, i.e. less than one ohm, to simply measure the current passing through it. In this case, switch SW3 could be a bipolar junction transistor (BJT) such as a high-gain Darlington that is driven in its linear range by the auxiliary controller IC3, or another controller such as an LM1949.

Overvoltage protection may also be provided through locating a breakdown diode, such as a zener diode or a transient voltage suppressor (TVS), between the injector's output terminal and ground 206, or between the injector's output terminal and the supply voltage (not shown). This is necessary to prevent inductive voltage spikes that occur when pass-through switch SW2 turns off from damaging the pass-through switch SW2 and the re-driver switch SW3. The overvoltage protection may likewise be employed with a circuit such as that displayed in FIG. 4, in lieu of a single breakdown diode, typically where several injectors are driven together in a bank. When the flyback voltage exceeds the zener voltage $V_Z$ plus the transistor emitter-base voltage Veb, then the majority of the flyback current is shunted through the transistor's collector to ground.

Figure 5:
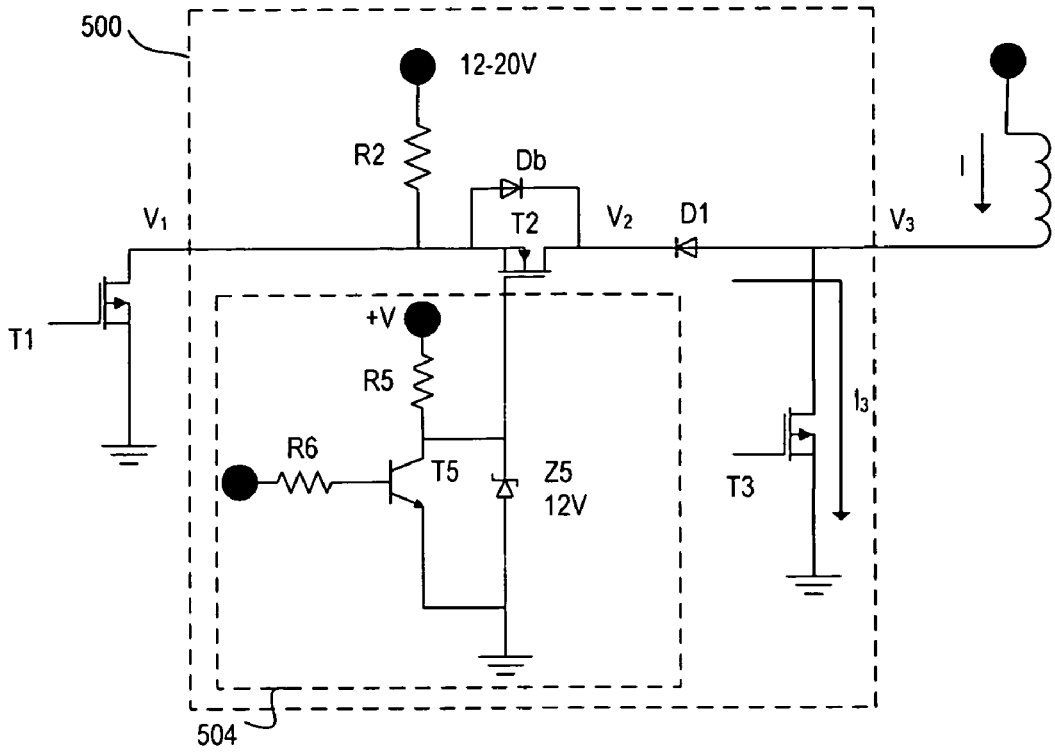
FIGS. 5 and 5*a* are circuit diagrams of embodiments of the isolation and gate drive circuitry of the pass-through switch SW2.
Figure 5A:
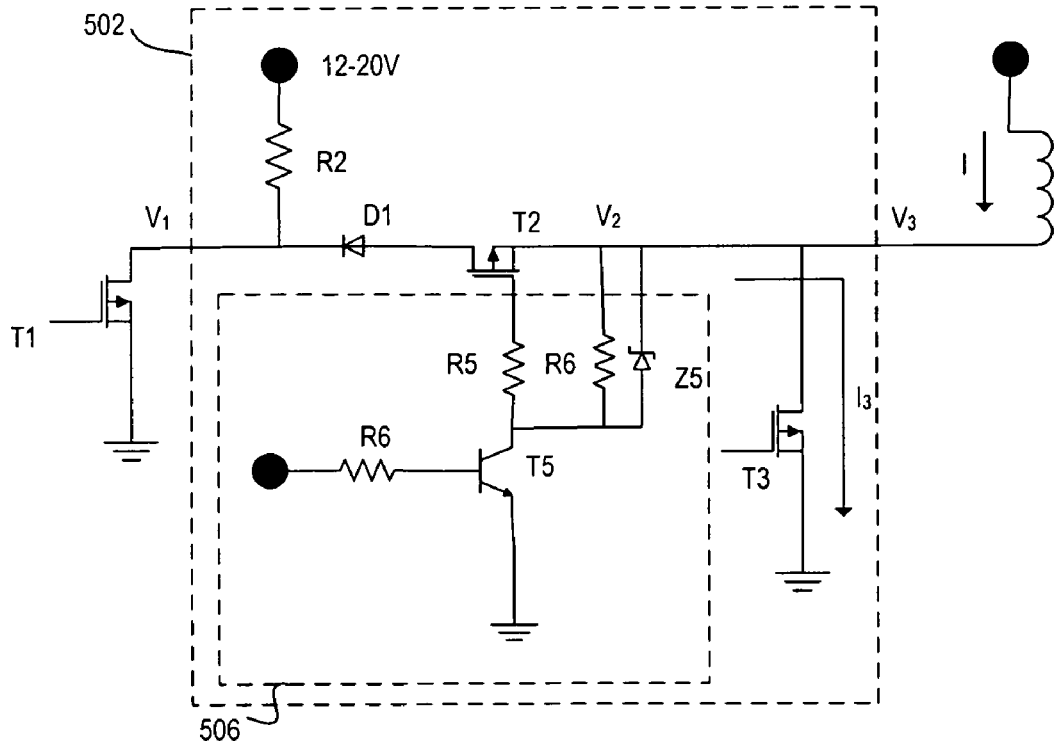

Referring to FIG. 5, one embodiment 500 is displayed for the isolation circuitry, including switches SW2 and SW3. Pass-through switch SW2 may be a power MOSFET (T2), here an N-type, and the re-driver switch SW3 may also be a power MOSFET (T3). In FIG. 5*a*, embodiment 502 includes a transistor T2 that is a P-type MOSFET. The gates of each T2 and T3 may be connected to the auxiliary controller IC3 for control of the pass-through and re-driver switches, respectively.

A gate drive circuit 504 may further be positioned between auxiliary controller IC3 and the gate of T2 to help drive the gate through quick switches between large voltage swings. A breakdown diode Z5 may be included to prevent voltage swings larger than 12 volts across the MOSFET (T2), thus providing gate protection. FIG. 5*a* includes another embodiment 506 of a gate drive circuit, this time driving an P-type MOSFET, with the breakdown diode Z5 providing similar gate protection.

As discussed, isolation circuitry may be included to prevent current $I_3$ (shown in FIG. 5) from leaking through the MOSFET (T2) during Add operation due to its body diode characteristics, displayed in FIG. 5 as Db. Current leaking $I_3$ may cause resistor R2 to pull down and V1 to go low, thus affecting the transparency of the pass-through circuit 208 to the main control system 202 when transistor T2 is off.

Alternative embodiments of the isolation circuit 208 include, therefore, positioning a diode D1 on either side of pass-through transistor T2, for instance, as seen in FIGS. 5 and 5*a*. This results in electrical isolation between pull-up resistor R2 and re-driver transistor T3, and may prevent current flow $I_3$ during Add operation. The diode D1 may also obviate the need to turn off the pass-through switch SW2 during Add operation because of the electrical isolation, which will prevent pull-down of resistor R2. In this way, T3 should have substantially only the current I running through it that has passed through injector 104.

Figure 6:
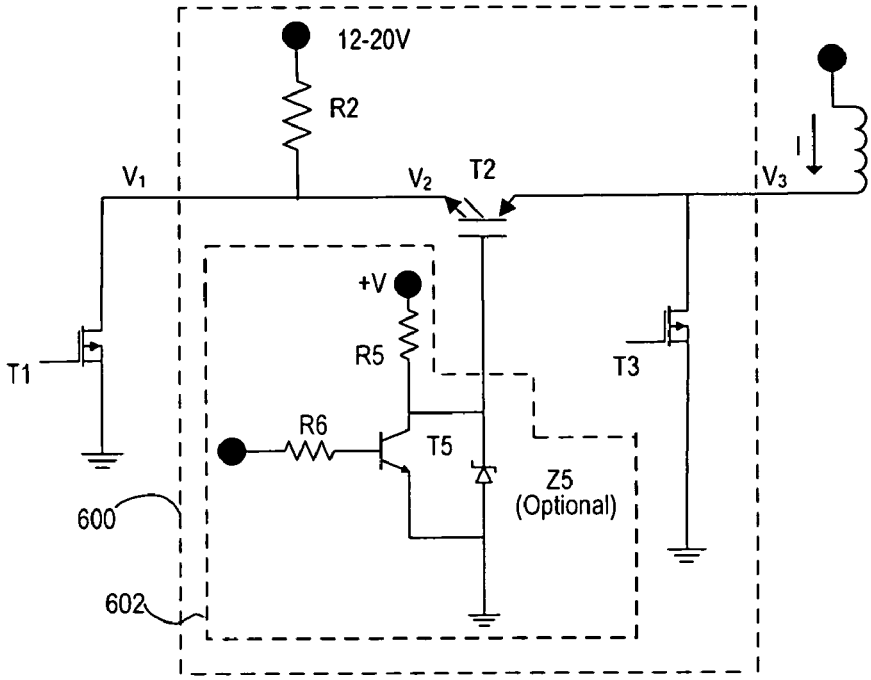
FIGS. 6, 6*a*, and 6*b* are circuit diagrams of further embodiments of FIG. 5.

FIG. 6 is another embodiment 600 of FIG. 5, this time employing an insulated gate bipolar transistor (IGBT) as T2 for pass-through switching. Because there are no body diode characteristics with IGBTs, a diode D1 is not required, although may be employed if the IGBT used cannot withstand a sufficiently high voltage for isolation. Note that if a diode is not used with an IGBT, pass-through transistor T2 must be turned off to ensure proper electrical isolation during Add operation, as discussed with reference to FIG. 5. A breakdown diode Z5 may allow the clamping of the gate voltage, thus providing sufficient gate protection during large voltage swings.

Figure 6A:
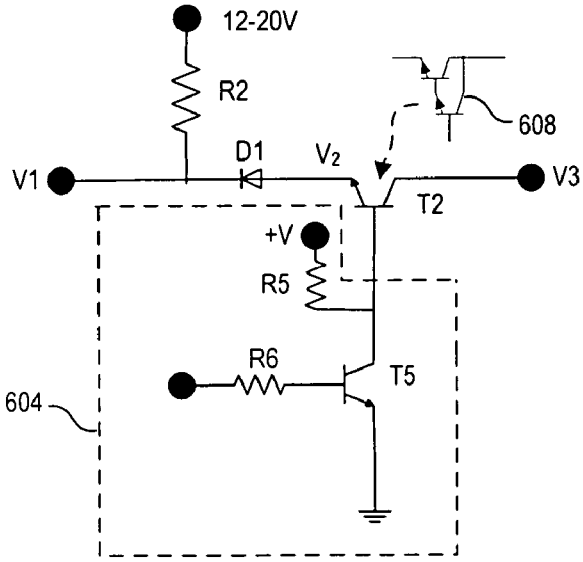
Figure 6B:
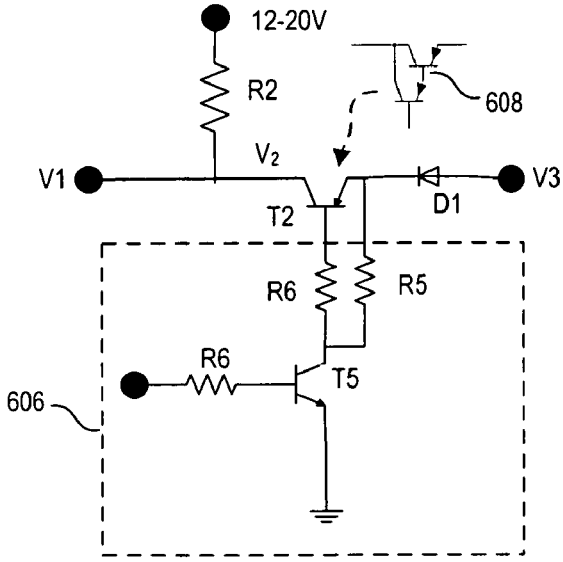

FIGS. 6*a* and 6*b* include alternative embodiments 604 and 606 of a base drive circuit when the pass-through transistor T2 is a BJT. FIG. 6*a* includes, for pass-through switch SW2, an NPN-type BJT while FIG. 6*b* includes a PNP-type BJT, but these BJTs may be switched between FIGS. 6*a* and 6*b*. In addition, a Darlington BJT 608 may be employed, either an NPN or a PNP type, in either FIG. 6*a* or 6*b*. Because BJTs cannot withstand a large reverse voltage placed across its emitter and collector, a diode D1 may be used to prevent the BJT's emitter-to-collector voltage from becoming negative. The diode D1 may be placed on either side of T2 in both FIGS. 6*a* and 6*b* even though not every possible option is shown.

As discussed, because of the presence of diode D1 with use of BJTs, pass-through transistor T2 of switch SW2 may remain on during Add operation when re-driver switch SW3 turns on. Where an NPN-type BJT is employed as transistor T2, including a diode D1 on the collector side, and when the emitter gets pulled high by resistor R2, keeping pass-through transistor T2 on, e.g. transistor T5 off, makes it easy to keep the base voltage within five volts of the emitter.

Figure 7:
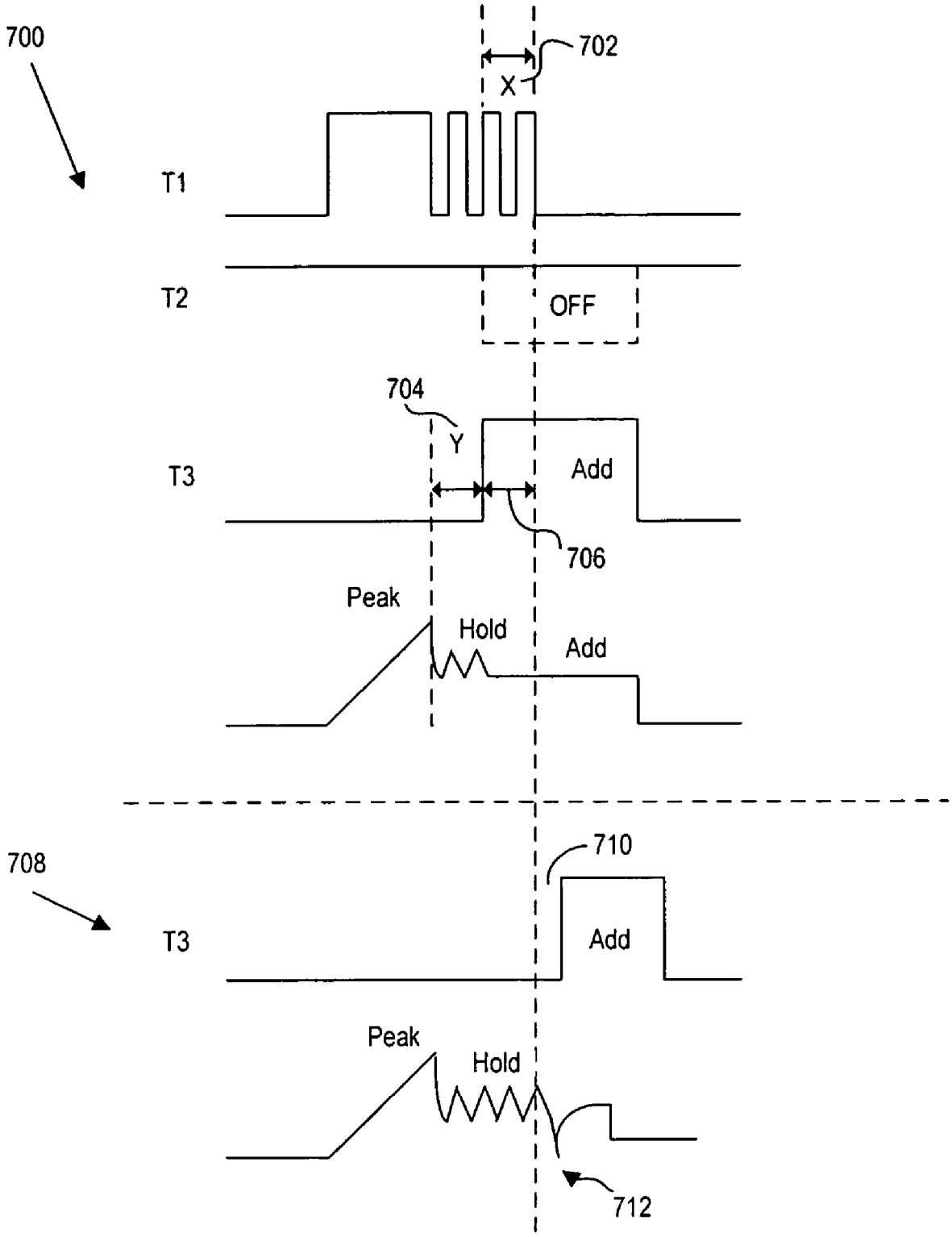
FIG. 7 is a set of waveforms related to FIGS. 5 and 6, displaying operation of an early drive embodiment of the add operation.

FIG. 7 includes a set of waveforms related to FIG. 2, displaying operation of an early drive embodiment 700 of the Add operation. Transistors T1-T3 refer to their respective switches SW1-SW3, and the waveforms for T1-T3 in FIG. 7 show whether T1-T3 are on or off, as opposed to high or low voltage. Early drive refers to anticipating the pulse-width injector signal going high (i.e. main transistor T1 turning off), and re-driving the injector 104 from some calculated time prior to the injector signal going high. For instance, a period X may be calculated 702 for which to cut the pulse-width short, and thus to send a signal to T3 to turn on and start the re-drive process.

Another option is to calculate 704 a period Y added on to the end of the time required to reach a peak in current I through the injector 104. In this case, time period Y is added to the pre-calculated period required to reach peak current, at which time auxiliary controller IC3 may turn on the re-driver transistor T3. Turning off the pass-through transistor T2 is optional, as discussed, which is reflected in the dashed curve. In either case, an additional early drive period 706 is added to the overall Add period, resulting in an overlap period 706 during which both re-drive transistor T3 and the main control transistor T1 are on simultaneously. The effect on the hold period is a firm, early transition to the Add re-drive period.

Additionally, low-impedance load with load switch SW4 may be employed during the early drive operation if the main controller IC1 is closely monitoring the hold current, $I_1$ in FIG. 2. In this case, when re-drive switch SW3 drives early, the pass-through switch SW2 may be turned off while the load switch SW4 may be turned on. Once the main control switch SW1 turns off and the re-driver switch SW3 is finished, then the pass-through switch SW2 resumes being on and the load switch SW4 turns off, completing the early drive Add operation of the injector.

The benefit of an early drive may be evident by comparing the possible results of current I without 708 the early drive embodiment. Note that re-drive transistor T3 may be delayed 710 because of the latency in the auxiliary controller IC3 reacting from receiving the main control switch SW1 input, to driving SW3, and thus may start to re-drive current I late. If this happens, the injector 104 may start to shut off 712 before getting turned back on again by the re-drive transistor T3. This may result in the injector 104 if the injector 104 is not being fully open during the add period, yielding a net result of less fuel added to the engine to enhance its performance.

One of the reasons for the latency in the auxiliary controller IC3 starting to re-drive switch SW3 is that the controller IC3 must decide whether transistor T1 is off for PWM or off for good. This is especially aggravated if the PWM off time varies. It may take a while to evaluate how late is too late, and ensuring a proper decision may cause re-drive switch SW3 to be turned on too late. For example, a sample PWM cycle from V1 can be measured by the auxiliary controller IC3 and the results can be applied to the present pulse to determine if the whole injector pulse is finished or if it is a continuation of the next PWM cycle. If the present pulse remains off (V1 high) for longer than, for instance, 10% more than the previous PWM cycle's off time, then the auxiliary controller IC3 may determine that the main control switch SW1 has been turned off to end the injector pulse period.

Figure 8:
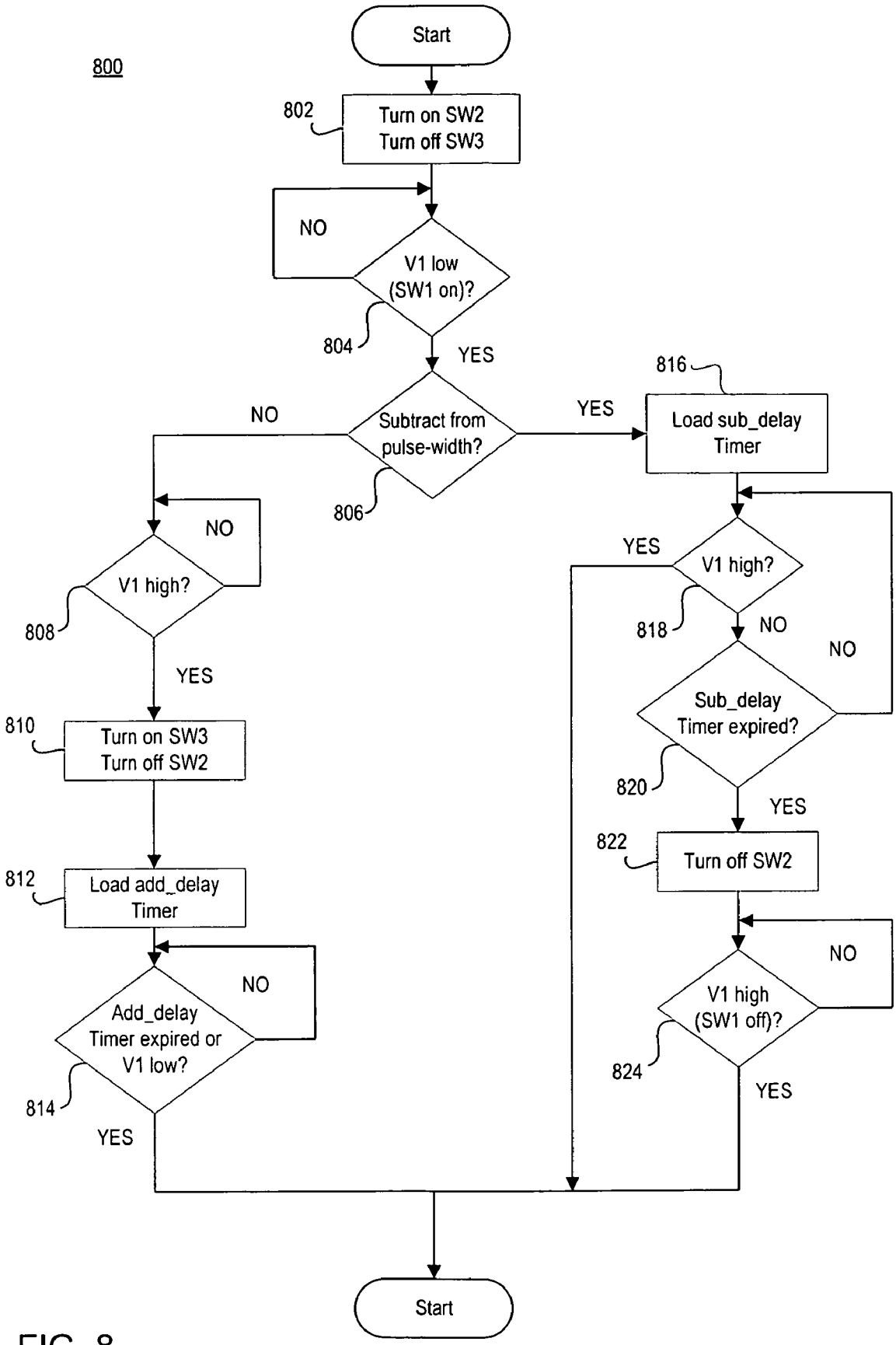
FIG. 8 is a flow chart of a method for modifying a pulse-width fuel injector control signal in add and subtract operations.
Figure 9:
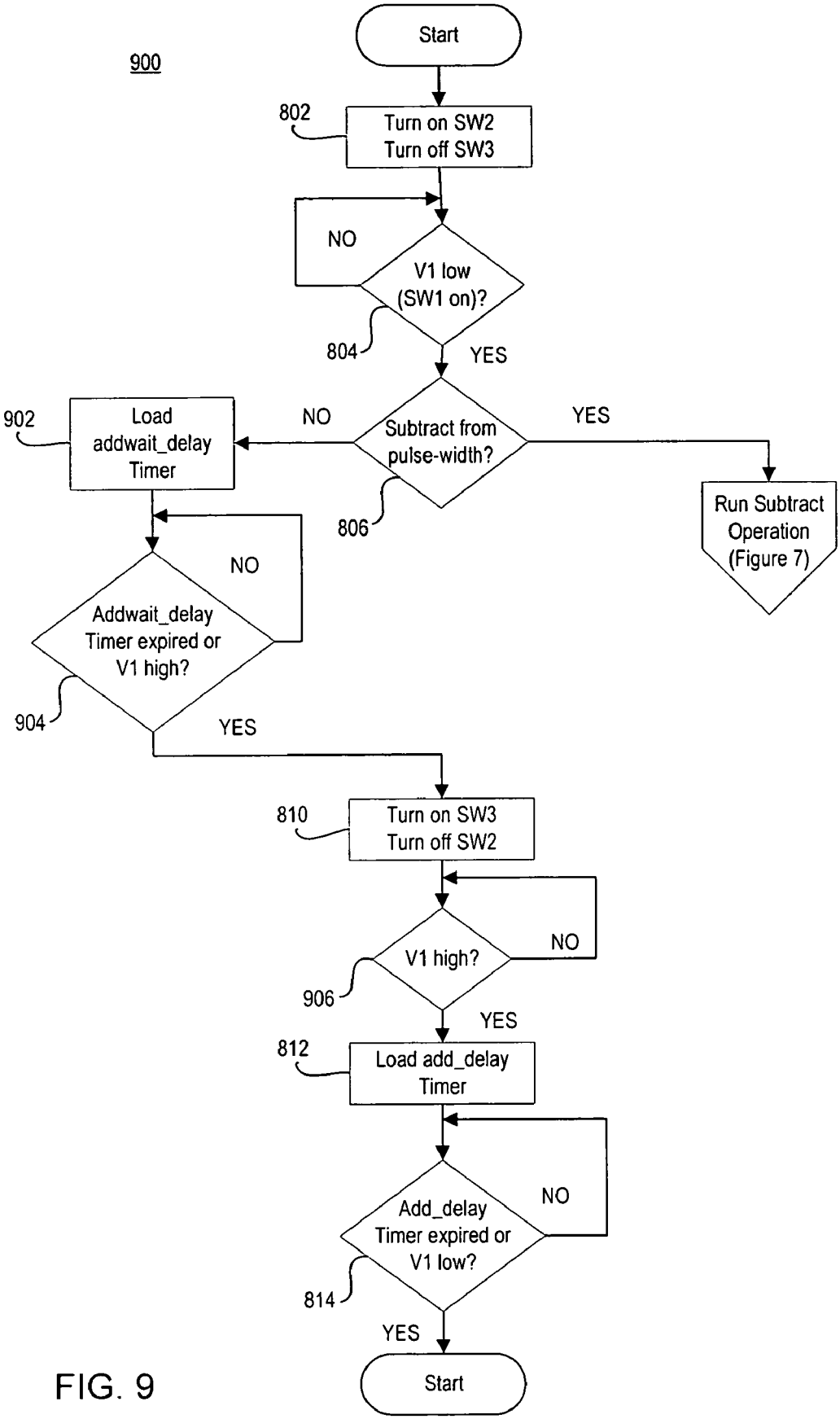
FIG. 9 is an early drive embodiment for the add operation of FIG. 8.
Figure 10:
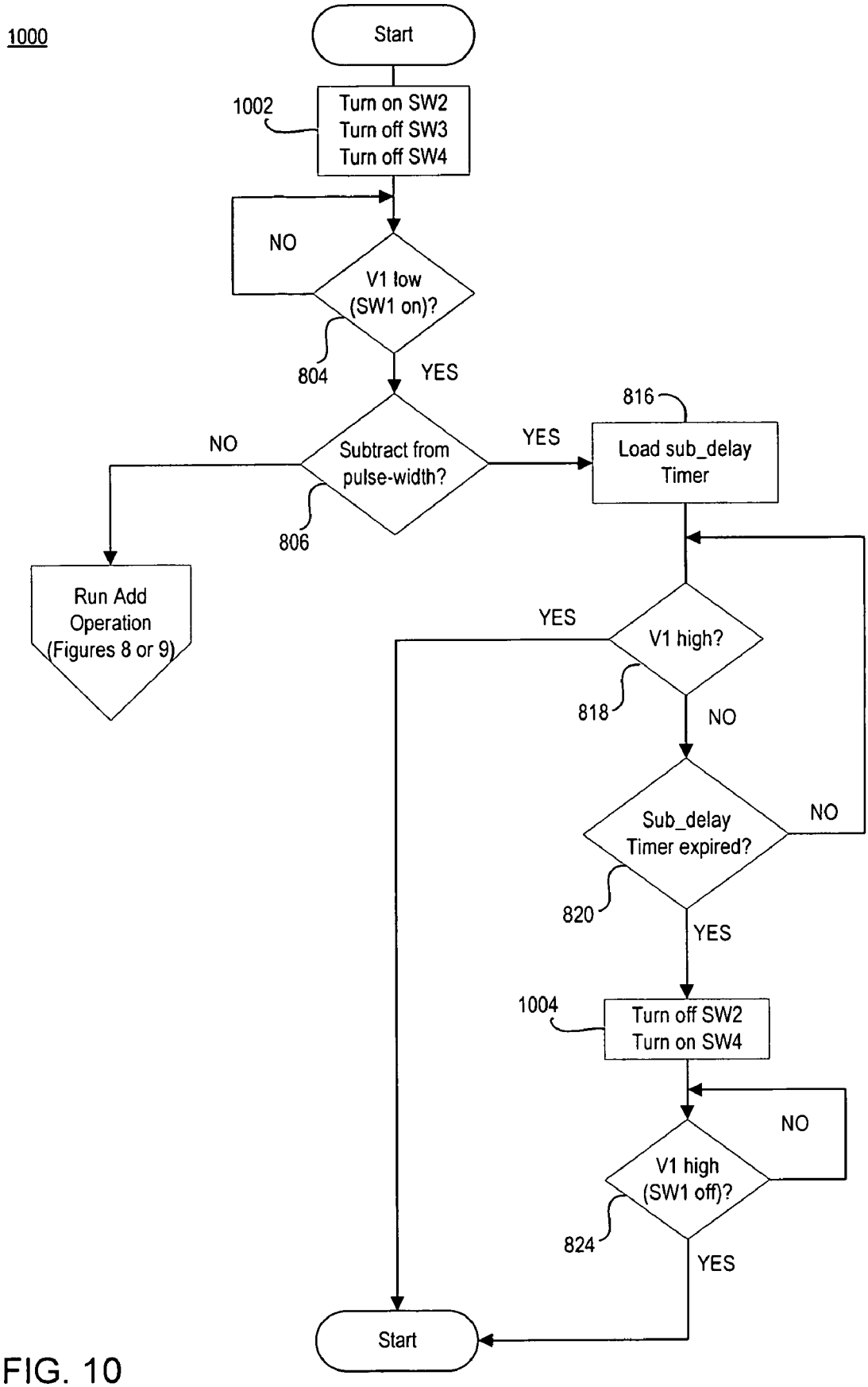
FIG. 10 is a low-impedance load embodiment for the subtract operation of FIG. 8.

The flow charts of FIGS. 8 through 10 are explained with the understanding that certain electrical hardware embodiments, as explained herein, may obviate the need to turn off the pass-through switch SW2 during Add operation. Thus, each Figure will be explained with turning off the pass-through SW2 as an option.

FIG. 8 is a flow chart of a method 800 for modifying a pulse-width fuel injector control signal in Add and Subtract operations of an auxiliary controller IC3. The method may begin by turning on 802 a pass-through switch SW2, and turning off 802 the re-driver switch SW3. The auxiliary controller IC3 may wait 804 for the injector pulse signal to go low, and then decide 806, based on a user-inputted setting, an engine sensor-inputted setting, or a pre-programmed setting, whether to add or subtract from the pulse-width.

If the decision is to Add, then the auxiliary controller IC3 may wait 808 until it detects the injector pulse signal going high, and then may turn on 810 the re-driver switch SW3, and optionally, turn off 810 the pass-through switch SW2. After that, an add_delay timer may be loaded 812. The add_delay period may be any calculated amount of time to increase the period. This period may be calculated as a percentage of the previous injector pulse width, as a fraction of the previous rpm period, or as a constant. However the change in pulse width is calculated, it is usually a scaler determined by user input or an engine sensor input that is multiplied by a value such as the previous pulse-width, an rpm period, or a constant. This result can then be added or subtracted from the existing (or previous) pulse-width value to determine how to modify the current pulse-width. Whatever method is used, once the add_delay period expires 814, the Add pulse period ends.

As an alternative, V1, the main control voltage signal, may be simultaneously monitored 814 for a low voltage, i.e. if the add_delay period runs too long and the main control switch SW1 turns on. If V1 goes low before the expiration of the add_delay timer, then the result is the same as the add_delay timer expiring: the Add pulse period ends, and the process restarts 802 by ensuring the re-driver switch SW3 is turned off and the pass-through switch SW2 is turned back on, if the latter was turned off in 810.

If the decision 806 is to Subtract, then the auxiliary controller IC3 loads 818 a sub_delay timer, and may monitor 818 the main control voltage signal (V1) for high voltage transition while the auxiliary controller IC3 waits 820 for the sub_delay timer to expire. The voltage signal V1 may be simultaneously monitored 818 for going high because the auxiliary controller IC3 may wait too long and miss the main control switch SW1 turning off. The sub_delay timer may be the previous injector pulse period minus a calculated amount of time to shorten the pulse. The sub_delay period may be determined by similar methods as those described for the add_delay period.

Once the sub_delay timer has expired 820, the auxiliary controller IC3 may turn off 822 the pass-through switch SW2, thus shortening the pulse, and wait 824 for the injector pulse signal to go high (i.e. the main control switch SW1 is off) before turning back on 802 the pass-through switch SW2, thus restarting the process.

Also, if voltage V1 goes high 818 at any time during the sub_delay timer decrementing 820, then the method 800 exits to restart, having never turned the pass-through switch on or off (as there would be no more pulse-width to shorten).

FIG. 9 is a flow chart of an early drive embodiment 900 for the Add operation of FIG. 7. Once an Add setting is detected 806, the auxiliary controller IC3 may load 902 an addwait_delay timer, which is a period of time short of a full pulse period. The auxiliary controller IC3 may then wait 904 for the addwait_delay timer to expire, at which time the auxiliary controller may turn on 810 the re-driver switch SW3 and may (optionally) turn off 810 the pass-through switch SW2. This allows the auxiliary controller IC3 to anticipate the voltage signal (V1) going high and thus begin the re-drive period a little early, which may prevent any delays in starting the re-drive period, as discussed with reference to FIG. 7. If V1 goes high 904 during the wait stage, the pulse Add period likewise begins 810.

The addwait_delay timer may be calculated by, for instance, subtracting a set time period from the previous injector pulse duration. The set time period may be the amount of early drive overlap time of both the re-driver switch SW3 and the main control switch SW1. The addwait_delay timer may also be a fixed delay (such as one to two milliseconds) during which the re-driver switch SW3 needs to wait for the injector current to pass its peak.

Once the re-driver switch SW3 begins 810 the re-drive Add period, the auxiliary controller IC3 may load 812 an add_delay timer and wait 814 for the timer to expire. This Add period may be longer than that of FIG. 8 so that the additional hold period is about the same despite starting re-drive early. Alternatively, the Add period can be started when V1 is detected 906 going high, with the Add period calculated as in FIG. 8. The input voltage V1 may also be simultaneously monitored 814 for going low. Upon expiration 814 of the add_delay timer or upon V1 going low 814, the process restarts by turning off 802 the re-driver switch SW3 and, if required, turning on 816 the pass-through switch SW2.

FIG. 10 is a flow chart of a method 1000 that may be used to control a switch SW4 of a low-impedance, dummy load 212 such as discussed with reference to FIG. 2. As before, the pass-through switch SW2 remains on during normal operation. The re-driver switch SW3 and low-impedance switch SW4 are both turned off 1002. The auxiliary controller IC3 may wait 804 for the injector pulse signal from a main control switch SW1 to go low (i.e. SW1 is turned on). The auxiliary controller IC3 may then detect 806 a user-inputted, an engine sensor-inputted, or a pre-programmed setting for Subtract operation.

As in FIG. 8, a sub_delay timer is loaded 816 and, simultaneously, the voltage V1 may be monitored 818 for going high. The auxiliary controller IC3 waits 820 for the sub_delay timer to expire, and continues to monitor 818 for V1 going high. The sub_delay period may be calculated as was explained with reference to FIG. 8. Also, if V1 goes high any time before the expiration 820 of the sub_delay timer, then the method 1000 exits back to starting conditions without having caused any additional switching.

Assuming the sub_delay counter expires before V1 goes high, the auxiliary controller IC3 may then turn off 1004 the pass-through switch SW2, thus shortening the pulse length. However, at the same time the pass-through switch SW2 is turned off, the auxiliary controller IC3 may turn on 1004 the low-impedance switch SW4. This will provide a truer hold current for a current-sensing main control system 202 to observe. Once the injector pulse signal (V1) goes high 824, the process may restart, turning 1002 on the pass-through switch SW2, and turning off the re-driver switch SW3 and the low-impedance switch SW4.

Alternatively, injector drive time can be subtracted from the front of the pulse drive period, as shown in FIG. 1*b*, except implemented with auxiliary controller IC3 of FIG. 2. This is not shown in FIG. 10, but would function as follows. The pass-through switch SW2 may be turned off and the low-impedance switch SW4 may be turned on in anticipation of the voltage pulse (V1) transition to low. When the voltage V1 goes low, a pre-determined time would expire before the pass-through switch SW2 is turned on and the low-impedance switch SW4 is turned off. The pre-determined time may be calculated as a percentage of the previous injector duty-cycle, as a multiple of a scalar constant, or by other means as explained with reference to FIG. 8. Current would then flow through the injector 104 until the main control switch SW1 turns off. If the next cycle is to be subtract, the pass-through switch SW2 may be turned off and the low-impedance switch SW4 may be turned on for the next cycle. If the next cycle is to be add, the pass-through switch SW2 may be left on and the low-impedance switch SW4 may by turned off.

What is claimed is:

1. An auxiliary electronic fuel injection control, comprising:

an isolation circuit connectable to a main control switch having an output voltage pulse and a ground;

a pass-through switch in electrical communication with the isolation circuit and connectable to a fuel injector, the isolation circuit to substantially render the pass-through switch transparent to the main control switch;

a re-driver switch in electrical communication with the pass-through switch and connected to the fuel injector and the ground, the re-driver switch including a resistor to sense the current running through the fuel injector; and an auxiliary controller in electrical communication with the pass-through switch, the re-driver switch, and with the ground, wherein the output voltage pulse triggers the auxiliary controller to turn the pass-through switch and the re-driver switch on and off to effectively alter a duration of current to the fuel injector.

2. The apparatus of claim 1, wherein the pass-through switch is on during normal operation and is turned off during pulse subtract operation.

3. The apparatus of claim 2, wherein, during pulse subtract operation, the auxiliary controller senses a low output voltage pulse, waits for a calculated period of time shorter than the width of the low output voltage pulse, and then turns off the pass-through switch until sensing a high output voltage pulse.

4. The apparatus of claim 2, wherein during pulse subtract operation, the auxiliary controller anticipates a low output voltage pulse, and turns off the pass-through switch for a calculated period of time after the output voltage pulse goes low before turning the pass-through switch back on, to resume normal operation.

5. The apparatus of claim 1, wherein the pass-through switch is turned off during pulse add operation.

6. The apparatus of claim 1, wherein, during a pulse add operation, the auxiliary controller senses a high output voltage pulse and then turns on the re-driver switch for a calculated period of time.

7. The apparatus of claim 6, wherein the auxiliary controller anticipates the output voltage pulse switching to high and turns on the re-driver switch at a calculated time before the output voltage switches to high.

8. The apparatus of claim 1, wherein the pass-through switch is a field-effect transistor (FET) having a gate, a source, and a drain, the apparatus further comprising a diode in electrical communication with at least one of the following: the FET's source and drain.

9. The apparatus of claim 8, wherein the FET is a metal-oxide semiconductor field-effect transistor (MOSFET).

10. The apparatus of claim 9, wherein the isolation circuit comprises a pull-up resistor connectable to a main power source and to the main control switch.

11. The apparatus of claim 1, wherein the pass-through switch is an insulated gate bipolar transistor (IGBT) having a gate, an emitter, and a collector.

12. The apparatus of claim 11, further comprising:

a diode connectable to the main control switch and coupled to at least one of the emitter and the collector of the IGBT; and a low-impedance load in electrical communication with the auxiliary controller and connectable to the main control switch.

13. The apparatus of claim 11, wherein the isolation circuit comprises a pull-up resistor connectable to a main power source and to the main control switch.

14. The apparatus of claim 13, further comprising a diode connectable to the main control switch and coupled to at least one of the emitter and collector of the IGBT.

15. The apparatus of claim 1, wherein the apparatus is connected to a bank of multiple injectors, the auxiliary controller to variably control each injector.

16. The apparatus of claim 1, wherein the isolation circuit comprises:

a pull-up resistor connectable to a main power source and to the main control switch; and a diode in electrical communication with the resistor and the pass-through switch.

17. The apparatus of claim 16, wherein the pass-through switch is at least one of the following: a bipolar junction transistor (BJT) and a Darlington BJT.

18. The apparatus of claim 1, wherein the isolation circuit comprises:

a pull-up resistor connectable to a main power source and to the main control switch; and a diode in electrical communication with the pass-through switch and the re-driver switch.

19. The apparatus of claim 18, wherein the pass-through switch is at least one of the following: a bipolar junction transistor (BJT) and a Darlington BJT.

20. The apparatus of claim 1, wherein the re-driver switch includes a MOSFET.

21. The apparatus of claim 1, further comprising a user interface connectable to the auxiliary controller, the user interface comprising:

a display panel to enable user output; and means for enabling user input.

22. The apparatus of claim 1, further comprising a low-impedance load, comprising:

a load switch in electrical communication with the auxiliary controller and connectable to the main control switch; and a resistor electrically in series with the load switch.

23. The apparatus of claim 1, wherein the re-driver switch includes a transistor, controllable by the auxiliary controller during pulse add operations.

24. The apparatus of claim 23, wherein the auxiliary controller drives the transistor with pulse-width modulation to limit the current through the transistor.

25. The apparatus of claim 1, wherein the re-driver switch comprises a high-gain Darlington BJT in series with the resistor, the resistor to pass a current signal to the auxiliary controller, which limits the current during pulse add operations by driving the high-gain Darlington BJT in its linear range.

26. The apparatus of claim 25, further comprising a diode in electrical communication with at least one of the high-gain Darlington BJT and the resistor, and in electrical communication with the pass-through switch.

27. An auxiliary electronic fuel injection control system, comprising:

a low-impedance load connectable to a main control switch having an output voltage pulse and a ground, the main control switch connectable to an output of a fuel injector;

a re-driver switch connected to a fuel injector, and in electrical communication with the main control switch and to the ground;

an auxiliary controller coupled to the low-impedance load, to the re-driver switch, and to the ground; and a pass-through switch circuit electrically coupling the main control switch to the output of the fuel injector, the pass-through switch in electrical communication with the re-driver switch and the low-impedance load, and controllable by the auxiliary controller.

28. The system of claim 27, wherein the pass-through switch circuit comprises:

a MOSFET controllable by the auxiliary controller; and a diode in electrical communication with the low-impedance load and coupled to the MOSFET, to provide electrical isolation between the low-impedance load and the re-driver switch.

29. The system of claim 28, wherein the low-impedance load comprises:

a load switch in electrical communication with the auxiliary controller and the diode; and a resistor in electrical series with the load switch, wherein at least one of the load switch and the resistor is connectable to a main power source.

30. The system of claim 29, wherein the resistor is replaced with an inductor.

31. The system of claim 27, wherein the pass-through switch circuit comprises an IGBT having a gate, an emitter, and a collector, the IGBT controlled by the auxiliary controller.

32. The system of claim 31, wherein the low-impedance load comprises:

a load switch in electrical communication with the auxiliary controller and the IGBT; and a resistor in electrical series with the load switch, wherein at least one of the load switch and the resistor is connectable to a main power source.

33. The system of claim 32, wherein the resistor is replaced with an inductor.

34. The system of claim 27, further comprising means to limit the current running through the fuel injector through the implementation of the re-driver switch.

35. A method for providing auxiliary control to an electronic fuel injector main controller having a main control switch, the method comprising:

turning on a pass-through switch to allow a main control voltage signal having a pulse-width to pass substantially unimpeded to a fuel injector;

sensing when the main control voltage signal switches to low;

detecting a setting to alter the pulse-width of the main control voltage signal; and with an auxiliary controller, coupled to the pass-through switch, adjusting the pulse-width of the main control voltage signal.

36. The method of claim 35, where the setting detected comes from at least one of the following: a user input, an engine sensor input, and a pre-programmed setting.

37. The method of claim 36, wherein for a setting of adding to the pulse-width, the method further comprising:

sensing when the main control voltage signal switches to high;

turning on a re-driver switch;

waiting for a calculated period of time or until the main control voltage signal switches to low; and turning off the re-driver switch.

38. The method of claim 37, further comprising:

while turning on the re-driver switch, turning off the pass-through switch; and while turning off the re-driver switch, turning on the pass-through switch.

39. The method of claim 36, wherein for a setting of adding to the pulse-width, the method further comprising:

waiting a calculated period of time short of the moment at which the main control voltage signal goes high;

turning on a re-driver switch;

waiting for a calculated period of time or until the main control voltage signal goes low, wherein the calculated period of time is calculated from at least one of the turning on of the re-driver switch and the main control voltage signal going high; and turning off the re-driver switch.

40. The method of claim 39, further comprising:

while turning on the re-driver switch, turning off the pass-through switch; and while turning off the re-driver switch, turning on the pass-through switch.

41. The method of claim 36, wherein for a setting of adding to the pulse-width during early add operation, the method further comprising:

waiting a calculated period of time short of the moment at which the main control voltage signal goes high;

turning on a re-driver switch;

turning on a load switch until the add period has ended, the load switch in operable communication with the main control switch and controllable by the auxiliary controller, the load switch to simulate an injector load;

waiting for a calculated period of time or until the main control voltage signal goes low; and turning off the re-driver switch.

42. The method of claim 41, further comprising:

while turning on the re-driver switch, turning off the pass-through switch; and while turning off the re-driver switch, turning on the pass-through switch.

43. The method of claim 36, wherein for a setting of subtracting from the pulse-width, the method further comprising:

waiting a calculated period of time less than the pulse-width period of the main control voltage signal;

turning off the pass-through switch;

waiting for the main control voltage signal to go high; and turning back on the pass-through switch.

44. The method of claim 36, wherein for a setting of subtracting from the pulse-width, the method further comprising:

waiting a calculated period of time less than the pulse-width period of the main control voltage signal;

turning off the pass-through switch;

turning on a load switch, the load switch in operable communication with the main control switch and controllable by the auxiliary controller, the load switch to simulate an injector load;

waiting for the main control voltage signal to go high;

turning off the load switch; and turning back on the pass-through switch.

45. The method of claim 36, wherein for a setting of subtracting from the pulse-width, the method further comprising:

anticipating the main control voltage signal going low;

turning off the pass-through switch;

waiting for a calculated period of time from the point at which the main control voltage goes low; and turning back on the pass-through switch.

46. The method of claim 45, further comprising:

while turning off the pass-through switch, turning on a load switch, the load switch in operable communication with the main control switch and controllable by the auxiliary controller, the load switch to simulate an injector load; and turning off the load switch when turning back on the pass-through switch.

47. A method for using an auxiliary control apparatus for controlling a fuel injector, the method comprising:

connecting to a main controller of a fuel injector an auxiliary fuel injection control apparatus comprising:

an isolation circuit connectable to a main control switch having an output voltage pulse and a ground;

a pass-through switch in electrical communication with the isolation circuit and connectable to a fuel injector, the isolation circuit to substantially render the pass-through switch transparent to the main control switch;

a re-driver switch in electrical communication with the pass-through switch and connectable to the fuel injector and the ground, the re-driver switch including a resistor to sense the current running through the fuel injector; and an auxiliary controller in electrical communication with the pass-through switch, the re-driver switch, and to the ground, wherein the output voltage pulse triggers the auxiliary controller to turn the pass-through switch and the re-driver switch on and off to effectively alter a duration of current to the fuel injector.

48. An auxiliary electronic fuel injection control to control the operation of a fuel injector, comprising:

a load switch electrically coupled to a main control switch having an output voltage pulse and a ground, wherein the load switch is configured to selectively electrically couple the output voltage of the main control switch to a load configured to substantially emulate an impedance of the fuel injector;

an isolation circuit electrically coupled to the low-impedance load switch;

a pass-through switch in electrical communication with the isolation circuit and connectable to the fuel injector, the isolation circuit to substantially render the pass-through switch transparent to the main control switch;

a re-driver switch in electrical communication with the pass-through switch and connectable to the fuel injector and the ground; and an auxiliary controller in electrical communication with the load switch, pass-through switch, the re-driver switch, and with the ground, wherein the output voltage pulse triggers the auxiliary controller to turn the low-impedance load switch, the pass-through switch and the re-driver switch on and off to effectively alter a duration of current to the fuel injector.

* * * * *

UNITED STATES PATENT AND TRADEMARK OFFICE

CERTIFICATE OF CORRECTION

PATENT NO. : 7,527,040 B2
APPLICATION NO. : 11/313425
DATED : May 5, 2009
INVENTOR(S) : David K. Couch It is certified that error appears in the above-identified patent and that said Letters Patent is hereby corrected as shown below:

Column 3, Line 27 reads, "...re-drive controller IC2 and the re-drive switch SW..." which should read, "...re-driver controller IC2 and the re-driver switch SW..."

Column 4, Line 19 reads, "...detecting any of these setting..." which should read, "...detecting any of these settings..."

Column 10, Line 39 reads, "...starting to re-drive switch..." which should read, "...starting to re-driver switch..."

Column 10, Line 43 reads, "...may cause re-drive switch..." which should read, "...may cause re-driver switch..."

Signed and Sealed this

First Day of September, 2009

David J. Kappos

David J. Kappos
*Director of the United States Patent and Trademark Office*